US005079475A

United States Patent [19]

Oortman Gerlings et al.

[11] Patent Number: 5,079,475

[45] Date of Patent: Jan. 7, 1992

[54] ELECTRIC INCANDESCENT LAMP HAVING A LOOPED FILAMENT SUPPORT MEMBER

[75] Inventors: Jan D. Oortman Gerlings; Mario J. A. Van Dijk, both of Eindhoven, Netherlands

[73] Assignee: U.S. Philips Corporation, New York, N.Y.

[21] Appl. No.: 595,126

[22] Filed: Oct. 9, 1990

[30] Foreign Application Priority Data

Dec. 1, 1989 [NL] Netherlands ..... 8902965

[51] Int. Cl.[5] ..... H01K 1/18

[52] U.S. Cl. ..... 313/279; 313/313; 313/274

[58] Field of Search ..... 313/279, 313, 578, 274

[56] References Cited

U.S. PATENT DOCUMENTS 3,195,000 7/1965 Reidenbach ..... 313/279
3,225,247 12/1965 Audesse et al. ..... 313/279
3,286,116 11/1966 Malm ..... 313/279
4,179,636 12/1979 Janssen ..... 313/274

FOREIGN PATENT DOCUMENTS 0217290 8/1987 European Pat. Off. .
0946149 1/1964 United Kingdom ..... 313/279
2041643 9/1980 United Kingdom .

*Primary Examiner*—Donald J. Yusko
*Assistant Examiner*—N. D. Patel
*Attorney, Agent, or Firm*—Robert J. Kraus

[57] ABSTRACT

A coiled-coil incandescent body (5) of an electric incandescent lamp has a single coil intermediate portion (12) extending axially in the lamp vessel (1) and surrounded by a support member (20). The support member comprises an open ring (21) with ends (22, 23) defining a gap (24). Portions (25, 26) of these ends (22, 23) extend towards the axis (2) and have bent end portions (27, 28) which are inserted into secondary turns (13, 14) of the incandescent body (5). The support member (20) cannot be shifted along the incandescent body (5).

4 Claims, 2 Drawing Sheets

ELECTRIC INCANDESCENT LAMP HAVING A LOOPED FILAMENT SUPPORT MEMBER

BACKGROUND OF THE INVENTION

The invention relates to an electric incandescent lamp comprising:

a tubular translucent lamp vessel having an axis and end portions which are sealed around respective current supply conductors;

an incandescent body made of helically coiled primary turns from which helically coiled secondary turns are formed, which incandescent body has end portions which are coiled in a double helical shape and are connected to respective current supply conductors, and which incandescent body furthermore is axially positioned in the lamp vessel and has a portion consisting of primary turns extending substantially in axial direction of the lamp vessel; and a support member of metal wire applied around the incandescent body in the position of the portion of primary turns, which support member rests against the lamp vessel and is connected to the incandescent body.

Such a lamp is known from U.S. Pat. No. 3,286,116. In the known lamp, the support is built up of two wire portions extending diametrically in the lamp vessel on either side of the incandescent body, which are together rigidly coiled over with wire in order to clamp in the incandescent body. The known support must be manufactured on the incandescent body. Its manufacture is difficult to mechanize and difficult to achieve without causing damage to the incandescent body.

Another drawback is that the incandescent body must be deformed in order to move the single-coil portion towards the axis of the incandescent body and position it coaxially in the lamp vessel. Indeed, if the coiled-coil incandescent body is made by coiling a single-coil wire around a mandrel, the portion of the incandescent body which remains singly coiled will run along the outer surface of the mandrel, excentrically with respect to the coiled-coil body.

Supports obtained by coiling wire for a few turns around the incandescent body, between the latter's turns, and then having it spiral out into a diameter corresponding to the lamp vessel diameter are very usual for incandescent bodies axially positioned in a tubular lamp vessel, both for single coil and for coiled-coil incandescent bodies, see for example GB 2,022,917. This construction is reliable for single-coil incandescent bodies. The support can be securely connected to the incandescent body. This construction has the drawback in the case of coiled-coil incandescent bodies, however, that the support is only loosely connected to the incandescent body. This is because the secondary turns, being formed from a series of primary turns, have little rigidity. Thus the support can easily move along the incandescent body, both before and after mounting of the incandescent body in the lamp vessel. A badly defined position of the incandescent body in the lamp vessel may be the result. This movement may be the cause of high wastage figures, both of incandescent bodies and of finished lamps.

U.S. Pat. No. 4,179,636 too discloses a lamp having a coiled-coil incandescent body. Here the incandescent body is formed by coiling around a secondary mandrel a wire which was first coiled helically around a primary mandrel and which has axially extending portions between the helically coiled portions. The single turns created from axially extending wire portions thus have the same internal diameter as the composite turns, i.e. the diameter of the secondary mandrel.

With both mandrels still present, a support is applied on a single-coil portion by overcoiling this portion with a piece of wire which spirals out into a larger diameter corresponding to the lamp vessel.

A drawback of this known lamp is that the support surrounds the incandescent body only loosely owing to the fact that the relatively thick primary mandrel is still present during coiling. A disadvantage associated with this is that an accurate radial positioning of the incandescent body in the lamp vessel, if desired, is not possible. Another disadvantage is that the presence of the support renders pickling out of the mandrels difficult and slow.

SUMMARY OF THE INVENTION

It is an object of the invention to provide a lamp of the type described in the opening paragraph which is of such a construction that it is inter alia reliable and easy to manufacture.

According to the invention, this object is achieved in that the support member has a first portion in the shape of an open ring having ends spaced apart, thus defining a gap, which ends are each connected to a second portion extending towards the axis of the lamp vessel, which second portion has a bent end portion which extends into the secondary turns of the incandescent body bordering on the portion having primary turns.

The support member of the incandescent lamp according to the invention has a great number of advantages. The support member makes a lamp possible which is reliable and easy to manufacture. The support member is placed on the incandescent body after the mandrels have been removed from it. Thus the support member has no delaying effect on mandrel removal. The support member can be manufactured separately from the incandescent body and as a result does not lead to a reduction in capacity of the coiling machine on which the incandescent body is manufactured. The support member can be easily attached to the incandescent body, without the incandescent body being manipulated. During attachment, the support member can be applied around the incandescent body by having the gap of the support member enclose the incandescent body and sliding the support member further over the incandescent body until the bent end portions of the second portions can be inserted in the secondary turns. During insertion, the support member may be elastically deformed in order to move the bent end portions closer together. After insertion, the support member springs back into its original shape. Provided the support member was correctly dimensioned, it is capable of positioning the incandescent body coaxially in the lamp vessel without the incandescent body itself having to be given a special shape for this purpose. The support member cannot leave its position around the section with primary turns of the incandescent body, not even under the influence of vibrations.

In a favourable embodiment, an end of a first portion is connected to a second portion of the support member by means of a third portion having the shape of an open ring with a gap, the gap of the first portion and the gap of the third portion being in one line substantially in the axial direction of the lamp vessel.

This embodiment has the advantage that the support member as a result of its shape less easily assumes a tilted position in the lamp vessel.

The resistance to tilting is increased even further in another embodiment in which the first and the third portions in the shape of an open ring are interconnected by a fourth portion which extends in axial direction of the lamp vessel. The first and third portions in the shape of an open ring thus are at a greater distance from one another.

For some lamps, for example for lamps which can also be operated in a position in which the lamp vessel axis is vertical, it is desirable to fix the support member relative to the lamp vessel. In a vertical position, a coiled-coil incandescent body can, in fact, owing to the slackness of its turns, easily sag so far down under the influence of its own weight that the bottom turns come into mutual contact. This short-circuit of turns causes an overload on the upper turns, and thus a shorter operating life. Even without short-circuit, sagging of the incandescent body has the disadvantage that changes in pitch among the turns occur, reductions below and increases above, which result in a lumen output of the lamp which is uneven along its axis. By fixing of the support member relative to the lamp vessel, for example by dimpling the lamp vessel at the position of the support member, an axial shifting of the incandescent body when being in a vertical operating position can be prevented. It is favourable if the support member assumes a pre-determined position relative to the incandescent body, and thus relative to the lamp vessel, so that such deformations, like dimples, of the lamp vessel can be realized in pre-determined locations for fixing the support member. In a favourable embodiment the interspacing of the bent end portions of the second portions of the support member, therefore, substantially correspond to the interspacing of the adjoining secondary turns at either end of the portion with primary turns. The support member is then substantially unable to shift in axial direction along the portion with primary turns.

It should be noted that DE 29 28 254 C2 corresponding to U.K. Patent No. 2,041,643 discloses an incandescent lamp having a tubular lamp vessel which is suitable for use as a photocopying lamp and in which the incandescent body has single-coil helically coiled longitudinal portions, which are interconnected by non-helically coiled longitudinal sections. The latter sections are connected to a support member. The support member is a straight piece of wire, coaxial with the lamp vessel, which is connected to an open ring at its ends. The non-helically coiled portion of the incandescent body is wound a few times around the straight piece of wire of the support member.

A similar lamp is known from EP 02 17 290, in which the incandescent body is built up from single-coil helical parts fastened to one another by a wire inserted into these parts, which wire has curled portions between its ends resting against the lamp vessel.

BRIEF DESCRIPTION OF THE DRAWING

Embodiments of the incandescent lamp according to the invention are shown in the drawing, in which.

DESCRIPTION OF THE PREFERRED EMBODIMENTS

Figure 1:
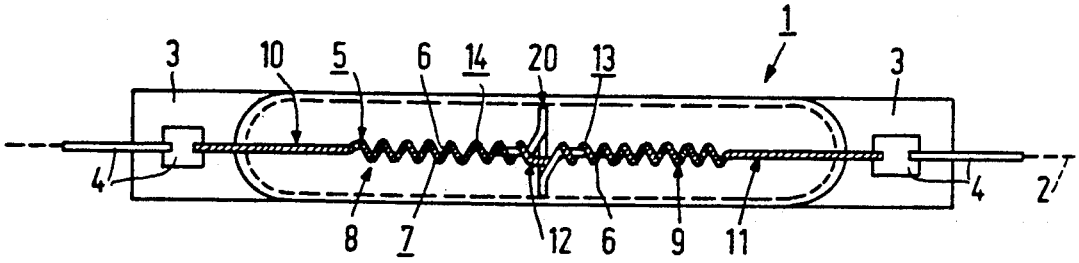
FIG. 1 is an embodiment in side elevation.

The electric incandescent lamp of FIG. 1 has a tubular translucent lamp vessel 1 made of, for example, hard glass or glass having a high $SiO_2$ content of, for example, at least 95% by weight, such as quartz glass, having an axis 2 and end portions 3 which are sealed around respective current supply conductors 4. The lamp vessel may be filled with a rare gas containing a halogen, for example in the form of hydrogen bromide. An incandescent body 5 of tungsten consisting of helically coiled primary turns 6, from which helically coiled secondary turns 7 are formed, is positioned axially in the lamp vessel 1. The incandescent body 5 has end portions 8, 9 which are coiled in a double helical shape and which are connected to respective current supply conductors 4, in the Figure via single-coil legs 10, 11. The incandescent body 5 has between its end portions 8, 9 a portion 12 of primary turns extending substantially in axial direction of the lamp vessel 1.

In the position of the portion 12 of primary turns, the lamp has a support member 20 of metal wire, for example tungsten, around the incandescent body 5, which support member rests against the lamp vessel 1 and is connected to the incandescent body.

Figure 2:
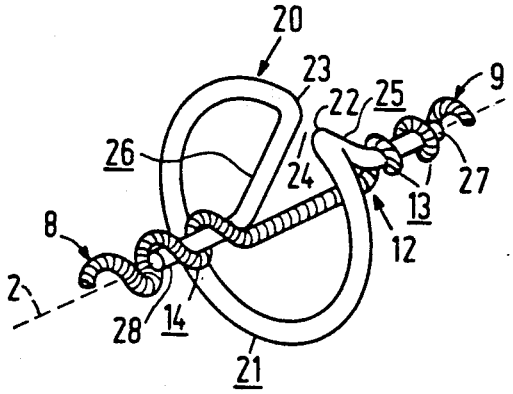
FIG. 2 represents a detail of FIG. 1 on an enlarged scale.

The support member 20 (FIG. 2) has a first portion 21 in the shape of an open ring with mutually spaced ends 22, 23, defining a gap 24. The ends 22, 23 are each connected to a second portion 25, 26, respectively, extending towards the axis 2 of the lamp vessel 1 and provided with a bent end portion 27, 28, respectively, which extends into the secondary turns 13, 14 of the incandescent body 5 adjoining the portion 12 of primary turns.

Figure 3:
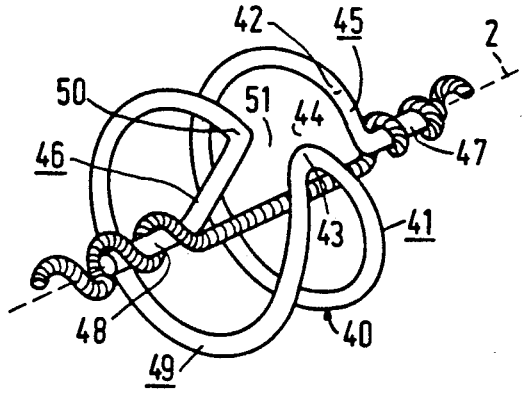
FIG. 3 shows a similar detail of a different embodiment.
Figure 4:
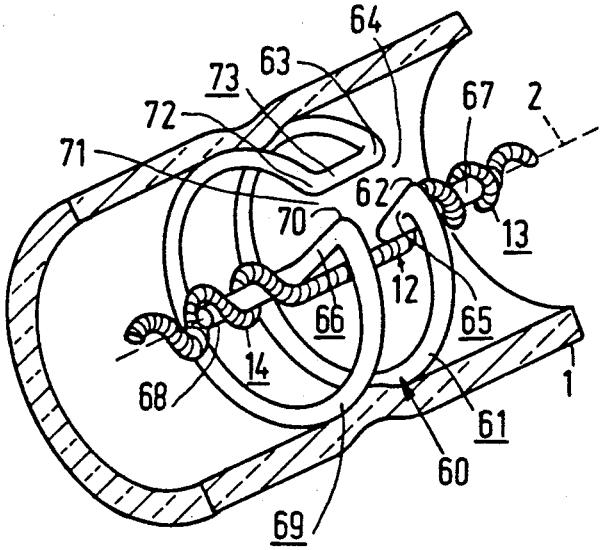
FIG. 4 shows a similar detail of a further embodiment.

In FIGS. 3 and 4, corresponding portions of the support member 40 and 60, respectively, have reference numerals which are 20 higher than those in the immediately preceding Figure each time.

In FIG. 3, the end 43 of the first portion 41 with the shape of an open ring is connected to a second portion 46 by a third portion 49 having the shape of an open ring and having an end 50 and a gap 51. The gaps 44, 51 lie in one line, which has the direction of the axis 2. The support 40 is more resistant to tilting, i.e. to assuming a position in which the bent end portions 47 and 48 enclose an angle with the axis 2, than is support 20 in FIGS. 1 and 2, owing to the fact that the support makes contact with the lamp vessel over a greater axial length.

In FIG. 4, the first portion 61 in the shape of an open ring and the third portion 69 in the shape of an open ring are interconnected by a fourth portion 73 which extends in the direction of the axis 2 of the lamp vessel. The gap 71 is defined by the ends 70, 72 of the third portion 69 having the shape of an open ring. The interspacing of the bent end portions 67, 68 corresponds substantially to the interspacing of the secondary turns 13, 14 adjoining the portion 12 with primary turns at either end. The support 60 as a result, just as the supports 20 and 40, is substantially unable to shift in axial direction along the portion 12 of the incandescent body 5. The support 60 is very resistant to tilting and can also be very easily fixed in the lamp vessel 1 when the lamp vessel is given a dimple between the portions 61, 69, which have the shape of an open ring and extend practically parallel.

The support can be easily mounted on the incandescent body, for example, by holding the incandescent body 5 at the current supply conductors 4 in a vertical position. The supports 20, 40, 60 are then directed towards the incandescent body with the gaps 24; 44, 51 or 64, 71, respectively, and moved towards the incandescent body, so that this incandescent body moves through the gap, for example with its portion 12, towards the centre of the support 20, 40, 60. The second portions 25, 26; 45, 46; 65, 66, respectively, can then be pressed towards one another, so that the support is elastically deformed. The bent end portions 27 and 28; 47 and 48; 67 and 68, respectively, are then inserted in the secondary turns 13, 14, upon which the support is released and springs back into its original shape.

Figure 5:
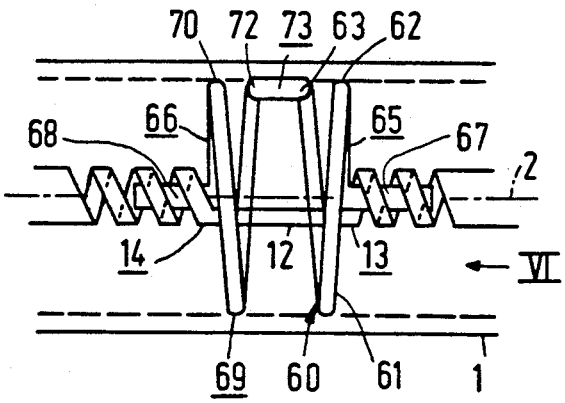
FIGS. 5 and 6 show a modification of FIG. 4, with the same reference numerals, in side elevation and viewed on the lamp vessel axis, respectively.
Figure 6:
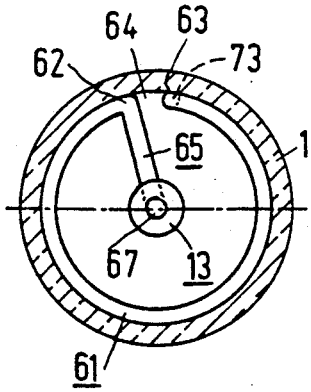

The support 60 of FIGS. 5 and 6 corresponds to that of FIG. 4, but the portions 61 and 69 having the shape of an open ring do not each lie in a flat plane, as is the case in FIG. 4.

It has been found that the lamp according to the invention has an incandescent body which is accurately positioned in the lamp vessel. The support member or, in the case of lamps with long incandescent bodies having several portions consisting of primary turns, the support members retain(s) their axial position on the incandescent body even when subjected to vibrations in a vertical position.

WE claim:

1. An electric incandescent lamp comprising:

a. a tubular translucent lamp vessel having a longitudinal axis and first and second end portions sealed around respective first and second current supply conductors;

b. an incandescent body comprising continuous helically coiled primary turns extending proximate the axis and including a substantially linear portion of the primary turns interposed between first and second helically coiled portions of the primary turns, opposite ends of said incandescent body being electrically connected to respective ones of the first and second supply conductors; and c. a metallic wire support member disposed around the linear portion of the primary turns, said support member including:

(1) at least one ring portion disposed adjacent an inner surface of the lamp vessel and having a discontinuity defining a gap through which the linear portion of the primary turns may be passed during installation of the support member; and (2) first and second bent end portions extending from opposite ends of the at least one ring portion toward and into respective ones of the first and second helically coiled portions of the primary turns, thereby securing the support member to the incandescent body and positioning said body in the lamp vessel.

2. An electric incandescent lamp as in claim 1 where the metallic wire support member comprises adjacent first and second ring portions extending around the linear portion of the primary turns in mutually opposite rotary directions, each of said first and second ring portions terminating in a respective one of the first and second bent end portions.

3. An electric incandescent lamp as in claim 2 where the first and second ring portions are joined by a portion of the support member which extends substantially parallel to the axis.

4. An electric incandescent lamp as in claim 1, 2, or 3 where the metallic wire support member is axially compressible to facilitate installation of the first and second bent end portions into the respective first and second helically coiled portions of the primary turns.

* * * * *